United States Patent [19]

Dixon

[11] 3,972,365

[45] Aug. 3, 1976

[54] EXTRUDED PLASTIC FOLDING DOOR

[75] Inventor: Guy E. Dixon, Miami, Fla.

[73] Assignee: Panelfold Doors, Inc. (Entire), Miami, Fla.

[22] Filed: Apr. 13, 1972

[21] Appl. No.: 243,734

[52] U.S. Cl. ..... 160/183; 160/235

[51] Int. Cl.[2] ..... E05D 11/08; E05D 11/06; E05D 7/00

[58] Field of Search ..... 160/183, 235, 345

[56] References Cited

UNITED STATES PATENTS

| | | | |
|---|---|---|---|
| 3,345,678 | 10/1967 | Graber et al. | 160/345 |
| 3,486,549 | 12/1969 | Rosenquist | 160/235 |
| 3,670,797 | 6/1972 | Sassano | 160/183 |

*Primary Examiner*—Peter M. Caun
*Attorney, Agent, or Firm*—Clarence A. O'Brien; Harvey B. Jacobson

[57] ABSTRACT

A door or other closure, partition or the like incorporating a plurality of substantially rigid panels having interengaging hinge structures formed unitarily along each side edge thereof with certain of the panels being supported by roller equipped carriage assemblies adapted to engage an overhead track. The hinge structures include means permitting relative vertical movement between adjacent panels to enable quick assembly and disassembly. An end clip for the hinge structures prevents relative vertical movement between adjacent panels after assembly with the clip being removable for disassembly. The overhead track is connected to a ceiling supported bracket or rail by an insert or latch which enables lateral engagement of the track with the bracket or rail to facilitate quick assembly and also to enable lateral disengagement of the track from the bracket or rail to enable quick removal or disassembly. The endmost panels are adapted for connection with specific jamb structures for facilitating opening and closing of the folding door.

13 Claims, 10 Drawing Figures

10
12
14
16
18
20
22
24
26
28
30
40
42
44
46
50
64
66
70
126
128
130
132
134
136
138
140
142
144
146
148
150
152
154
166
168
170

10
12
14
16
18
20
22
24
30
34
38
40
50
70

12
54
70
78
80
86
98
100
102
116
118

EXTRUDED PLASTIC FOLDING DOOR

BACKGROUND OF THE INVENTION

1. Field of the Invention

The present invention generally relates to a folding door including a plurality of substantially rigid panels having hinge structures unitarily incorporated along each side edge thereof and supported for movement from an extended position where the panels are disposed in an obtuse angular relation and a position in which the panels are disposed in acute angular relation in which the connection between adjacent panels and related supporting structures are unique.

2. Description of the Prior Art

Many efforts have been made to provide folding doors, panels, closures or the like in which relatively narrow rigid panels are hingedly interconnected along their side edges and supported from an overhead track. When such panels are constructed of relatively thin material such as extruded plastic material or the like, particular problems have arisen in providing a hinged connection between adjacent panels and also maintaining the panels in assembled condition and effectively supporting the panels from an overhead support. Prior U.S. Pat. Nos. 3,486,549 issued Dec. 30, 1969 and 3,516,473 issued June 23, 1970 are exemplary of previous patents which disclose some of the prior attempts to solve the problems as discussed above.

SUMMARY OF THE INVENTION

An object of the invention is to provide a folding door constructed of a plurality of relatively thin, substantially rigid vertically elongated panels of extruded plastic or the like and which have continuous interconnecting hinge structures formed on the vertical side edges thereof which facilitate easy and quick assembly and disassembly of the panels. The hinge structures are of one-piece of unitary construction with the panels and are barely visible and do not detract from the appearance of the door. The jamb structures include channel-shaped jamb moldings and anchor brackets having interengaging ribs to facilitate quick installation and removal of the door by telescoping the moldings over the brackets until the ribs are engaged.

Another object of the invention is to provide a folding door in accordance with the preceding object and including in the hinge structure a stop or limit member which limits movement of the panels toward their extended position.

A further object of the invention is to provide a folding door in accordance with the preceding objects in which end caps or plugs are provided for the hinge structures to enable relative vertical movement between adjacent panels to permit easy assembly and disassembly and prevent such vertical movement when inserted into the ends of the hinge structures.

Still another important feature of the present invention is to provide a folding door in accordance with the preceding objects in which jamb engaging components are provided on the endmost panels of the door.

Yet another important object of the invention is to provide a folding door having a plurality of panels, some of which are supported from an overhead track by roller carriages or the like with the track being supported from a supporting bracket or rail with the connection between the track and bracket requiring relative lateral movement therebetween with a fastening latch being provided to enable assembly and disassembly of the track with respect to the bracket by selectively locking the track to the bracket.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
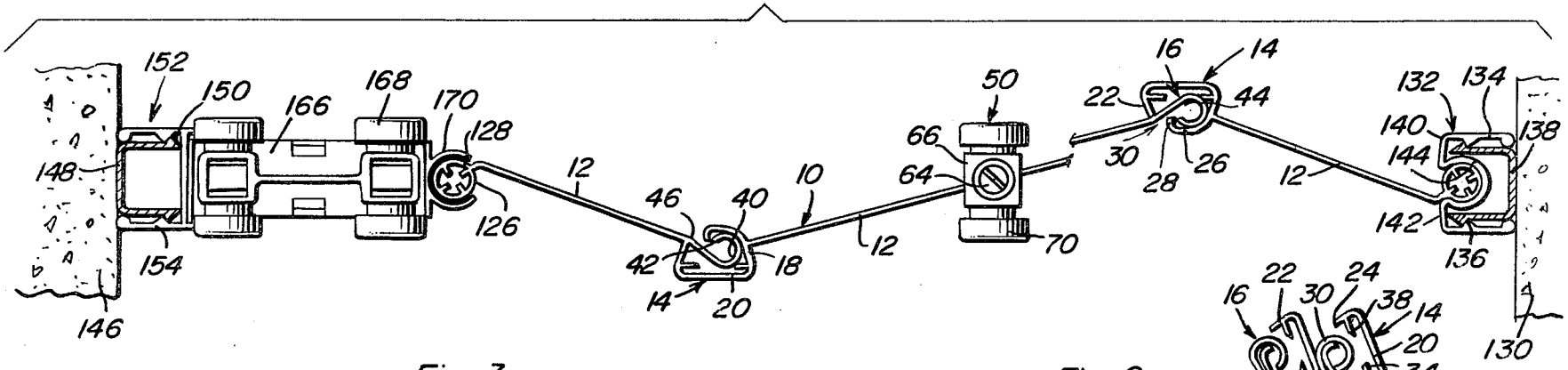
FIG. 1 is a top plan view of a folding door, with portions broken away, illustrating the relationship of the door components when in extended position.

Referring now specifically to the drawings, the folding door of the present invention is generally designated by reference numeral 10 and includes a plurality of substantially rigid, vertically elongated panels 12, preferably constructed of plastic material and being relatively thin but substantially rigid. The length of the panels 12 is determined by the vertical dimension desired and the width of the panels may also vary although it is preferred that when the panels are in extended position, the distance from center to center of adjacent panel should be a minimum of 4 inches. The panels may be constructed of various materials but are preferably constructed of an extruded plastic such as polyvinychloride.

Each of the intermediate panels includes a vertically continuous hinge element generally designated as numeral 14 on one edge and a continuous hinge element 16 on the opposite edge with the hinge components being of unitary construction on the panels 12 and formed on the panels 12 when the panels are formed.

Figure 2:
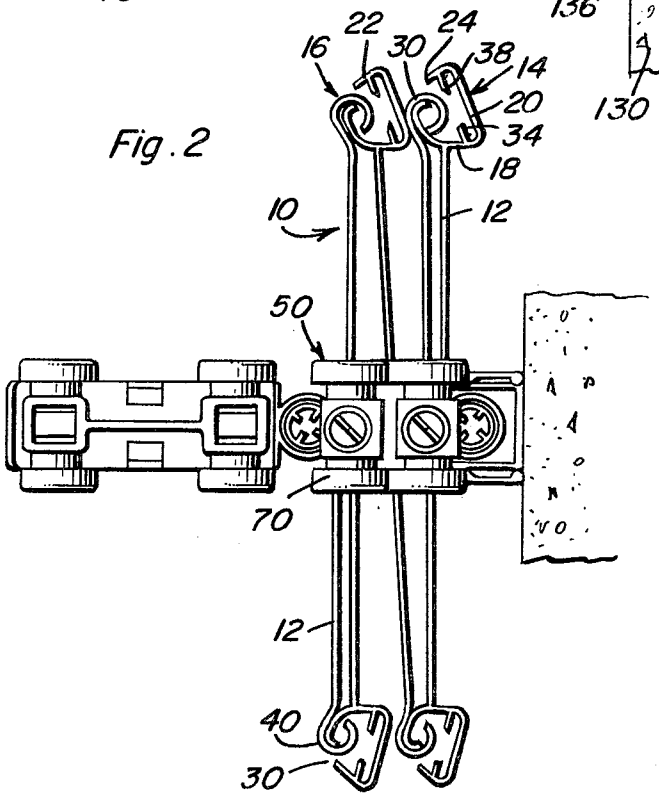
FIG. 2 is a plan view similar to FIG. 1 but with the door components in retracted position.

The hinge element 14 is generally of channel-shaped configuration and includes a flange 18 that is generally perpendicular to the panel although slightly inclined in relation thereto as illustrated in FIGS. 1 and 2. Extending from one edge of the flange 18 is a flange 20 which is in acute angular relation to the flange 18 and slightly wider than the flange 18. Connected with the opposite edge of the flange 20, there is a flange 22 having a free edge 24 thereon with the flange 22 being in acute angular relation to the flange 20 and converging in relation to the flange 18. The edge of the flange 18 opposite from its connection with flange 20 is provided with a flange 26 which is narrower than flange 20 and disposed in opposed relation thereto and generally parallel thereto although slightly divergent in relation thereto. The flange 26 terminates in an in-turned relatively narrow free edge portion 28 to provide an entrance area or throat 30 for the panel 12 having the hinge element 16 thereon.

The flange 18 is provided with an inwardly projecting flange 32 having a beveled free inner edge 34 and the flange 22 is provided with an inwardly projecting flange 36 having a beveled free inner edge 38. As illustrated, the flanges 32 and 36 are in alignment with each other and the beveled edges 34 and 38 are spaced from each other and form surfaces for engaging the exterior of the hinge element 16 during relative pivotal movement of the panels 12.

Figures 4, 5, 6, 7, 8, 9, 10:
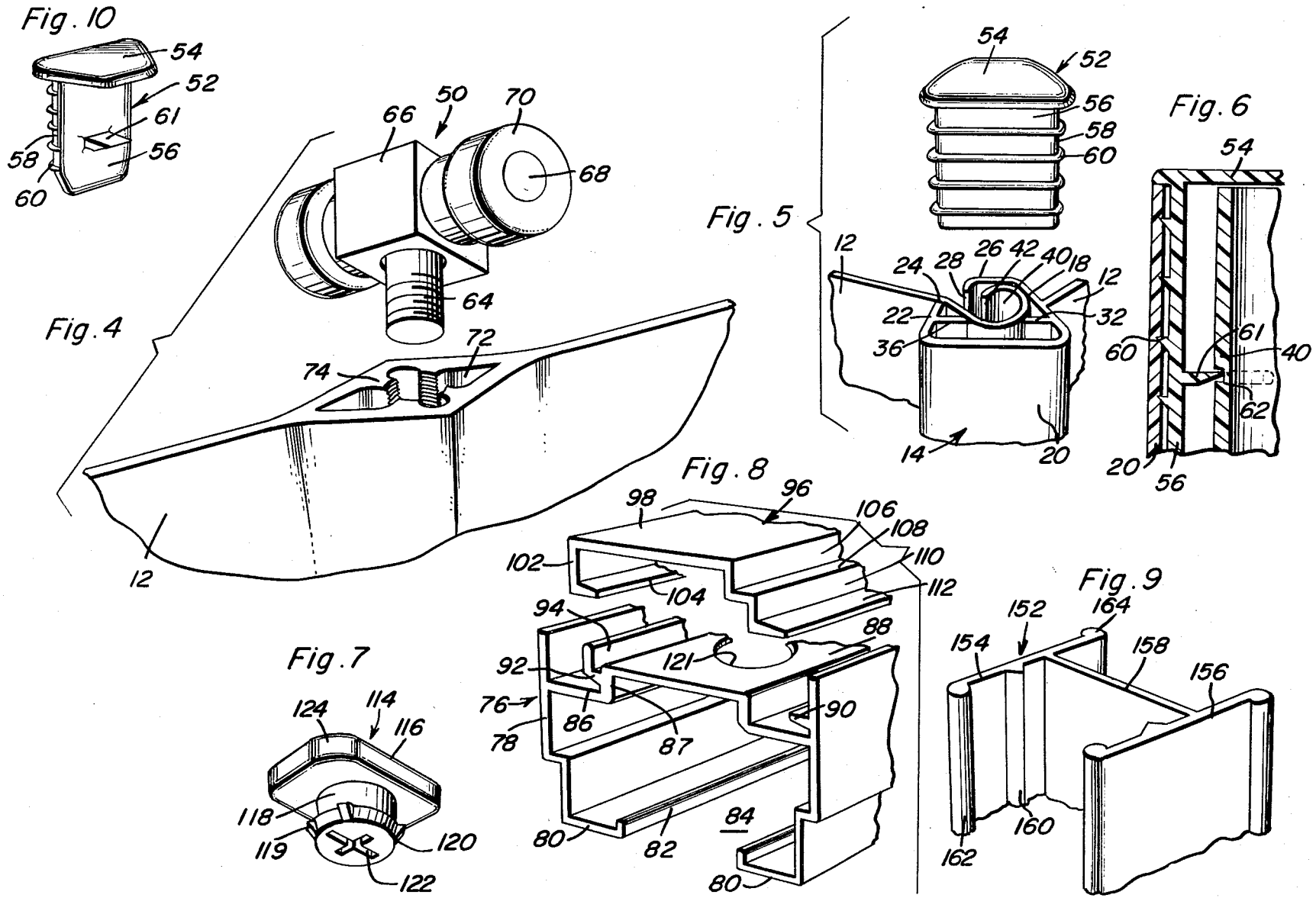
FIG. 4 is an exploded perspective view illustrating the top edge of one of the door panels and a roller carriage associated therewith.
FIG. 5 is an exploded perspective view illustrating a hinge connection between adjacent panels and the clip or plug for insertion therein.
FIG. 6 is a sectional view of the construction of FIG. 5 illustrating the structural details of the assembly of FIG. 5.
FIG. 7 is a perspective view of a retaining latch for securing the track onto a supporting bracket or rail.
FIG. 8 is a fragmental perspective view illustrating the structure of the track and supporting rail with the two components separated from each other.
FIG. 9 is a perspective view of a jamb molding employed along one edge of the door.
FIG. 10 is a perspective view of the end clip.

The hinge element 16 which may be considered the male hinge element is in the form of a cylindrical member 40 formed on the panel 12 with the cylinder being not quite closed thus leaving a free edge 42 on the cylindrical member and defining an entrance area or throat 44. The cylindrical member 40 is offset slightly from the plane of the panel 12 as indicated at 46 and as illustrated in FIGS. 1, 2 and 5.

When adjacent panels 12 are assembled, they are longitudinally engaged with each other by inserting an end of the male hinge element 16 into an end of the female hinge element 14 and then moving the panels into side by side relation. When the door is folded as in FIG. 2, the outer surface of the flange 26 is disposed alongside of the offset portion 46 of the panel 12 to which the cylindrical member 40 is connected. As the panels 12 move to an extended position, the free edge 42 of the cylindrical member 40 will move along the inner surface of the flange 26 and at the same time the outer surface of the cylindrical member 40 will engage the inclined surface 38 and possibly the inclined surface 34 and ultimately, the cylindrical surface 40 will engage the inner surface of the flange 26 and possibly the inner surface of member of the flange 18 until the panels are in their fully extended position with the movement of the panels being limited toward their extended position by engagement of the offset portion 46 of the panel 12 with the free edge of the flange 22 as illustrated in FIGS. 1 and 5. Thus, there is a continuous engagement of surfaces in the hinge elements to provide a constant barrier to passage of light, noise, sound, air and the like and also, the hinge elements are constructed of the same material as the panels 12 and may be formed during an extrusion operation and have some degree of flexibility in assembly and operation. All of the corners between the flanges are radiused. While dimensions may vary, it has been found that if the diameter of the male hinge element 16 is .250 inches, then an imaginary circle defined by the surface 32, the inner radius of the juncture between flanges 18 and 26 and the in-turned edge 28 would also be the same dimension. Also, the dimensions of the panel may vary and the exact angle of inclination of the offset portion 46 and the exact angle of inclination of the various flanges in relation to the panel 12 and in relation to each other are also capable of some variation but the arrangement as illustrated has been found to operate successfully.

In supporting the door, certain of the panels 12 are supported by roller assemblies or carriages 50 with other of the panels being unsupported. In order to enable easy and quick assembly and disassembly of the panels but yet prevent relative vertical movement between the supported and unsupported panels 12 when assembled, end caps, plugs or clips 52 are provided for insertion into the ends of the female hinge elements 14 with the cap 52 including a top plate 54 which conforms in shape and configuration to the top edges of the flanges 18, 20, 22, 26 and 28 and thus forms a closure for the end of the hinge element 14 to provide not only a limiting cap but also a finished appearance to the hinge structure since this plate will also conceal the top edge of the male hinge element 16. The plate 54 includes a depending wall 56 which has rounded side edges 58 which correspond with the area defined by the inner surface of the flange 20 and the inner surfaces of the flanges 18 and 22 between the flange 20 and the flanges 32 and 36. The outer surface of the wall 56 and the rounded edges 58 are provided with ribs 60 of generally right triangular configuration with the upper surface of the ribs 60 being generally perpendicular to the corresponding wall 56 and edges 58. The ribs 60 frictionally engage the inner surface of the correspondingly shaped flange surfaces on hinge element 14 thereby locking the end caps 52 in place but permitting removal thereof when desired. The wall 56 includes a laterally extending flange or tooth 61 which snaps into a peripheral saw kerf or groove 62 on the outer surface of the cylindrical member 40 to prevent relative vertical movement of the panels 12 when the clip is installed. The clips may be constructed of plastic, metal or any suitable material and may be bonded in place with a suitable adhesive if desired.

Each of the roller assemblies or carriages 50 include a depending threaded member 64 journaled in a supporting block 66 having an axle 68 extending laterally from each side thereof receiving wheels or rollers 70 thereon. The depending threaded member is adapted to be threaded into and secured to a hollow area or recess 72 in the upper edge portion of a panel 12 with the hollow area including inwardly extending ribs 74 which may be provided with segmental threads on the inner surface thereof thus connecting the panel to the roller assembly or carriage. Various techniques may be employed for securing the panel 12 to the carriage 50 so that the panels may move between the retracted and extended positions.

Figure 3:
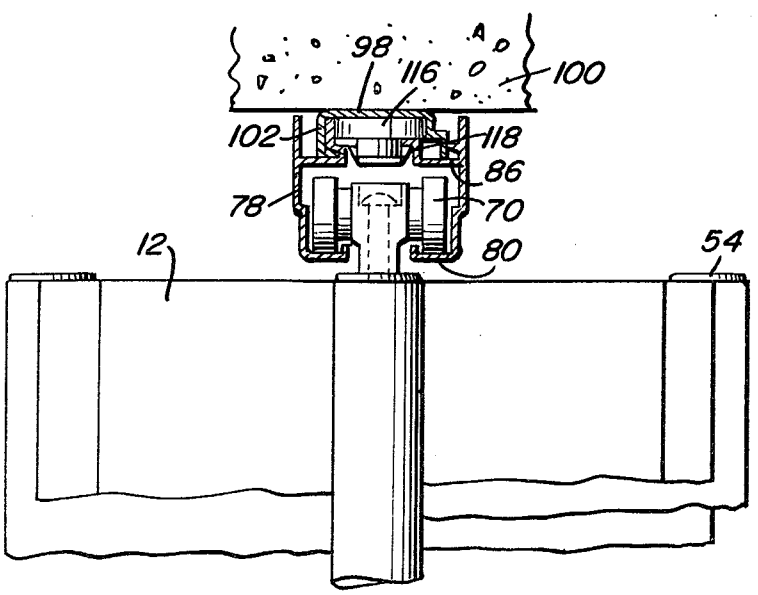
FIG. 3 is a vertical sectional view of the supporting track, roller carriage and bracket or rail structure for the track.

The carriages 50 are supported from an overhead track 76 which includes vertical side flanges 78 terminating in inwardly extending flanges 80 having upturned free edges or flanges 82 that are spaced from each other and form a longitudinal slot 84 for receiving the depending supporting rods or fasteners 64. The upper surfaces of the flanges 80 form a support for the rollers or wheels 70 in a well known manner as illustrated in Fig. 3. The vertical flanges 78 are rigidly interconnected by a horizontal flange 86 that has an upwardly offset central portion 88 with the top edges of the side flanges 78 being disposed above the central portion 88 of the horizontal flange 86. One of the side flanges 78 is provided with an inwardly extending flange or rib 90 having an inclined lower surface which is spaced above the corresponding portion of the horizontal flange 86. The flange 90 extends toward the offset portion of the horizontal flange 86 which interconnects the central portion 88 with the flange 86 with this offset portion being designated by numeral 87. The offset portion 87 remote from the flange 90 is provided with a similar projecting flange 92 which extends toward the opposite side flange 78 and is provided with a similarly inclined bottom surface. The free edge of the flange 92 is provided with a relatively short vertically extending flange 94 which is generally parallel to but spaced from the adjacent side flange 78 and terminates slightly below the top edge of the side flange 78.

The flanges 90 and 92 form an engaging structure for a mounting bracket, rail or clip generally designated by the numeral 96 and which includes a top horizontal flange 98 secured to an overhead supporting structure 100. One edge of flange 98 is provided with a depending vertical flange 102 having an in-turned flange 104 that has an inclined upper surface that corresponds to the inclined lower surface on the flange 92. The opposite edge of the flange 98 is provided with a relatively short vertical depending flange 106, a relatively narrow outwardly extending flange 108 perpendicular with the flange 106 and a second vertical flange 110 that is relatively short and a laterally extending flange 112 that has an upper surface inclined in the same manner as the lower surface of the flange 90 on the side flange 78. The track 76 is assembled with the bracket 96 by vertically moving the track upwardly until the horizontal flange 86 engages with the bottom surfaces of the flanges 104 and 112. The track 76 is then moved laterally to bring the surfaces of the flanges 104 and 112 into underlying engagement with the flanges 90 and 92. When thus assembled, the outer surface of the flange 94 will be disposed alongside and in engagement with the inner surface of the flange 102 and the outer surface of the flange 110 will be disposed along the free edge of the flange 90 and the juncture between the flanges 106 and 108 will be disposed adjacent the juncture between the central portion 88 and the offset flange 87 of the horizontal flange 86 as illustrated in FIG. 3. This will then provide an interlocking engagement between the track 76 and the mounting bracket, rail or clip 96.

In order to retain the interlocked engagement between the track 76 and the bracket 96, track latches generally designated by numeral 114 are provided which are in the form of a generally rectangular plate 116 having a depending cylindrical stud 118 thereon that is provided with a slightly inwardly tapered lower end 120 which also has a kerf 122 therein for receiving a screwdriver, such as a Phillips screwdriver, or other similar turning instrument. The stud or shank 118 also includes a plurality of lugs 119 thereon which have an outer surface which tapers upwardly to enable the stud 118 to be inserted downwardly through a hole 121 in the track flange 88 thereby assembling the latches 114 with the track 76.

The rectangular block 116 has diagonally opposed corners thereof rounded or radiused as designated by numeral 124 and the plate 116 is oriented lengthwise along the top surface of flange 88. When the track 76 is assembled with bracket 96, the plate 116 is disposed in the area between the inner surface of the vertical flange 106 and the inner surface of the flange 94. The retaining latch 114 may then be rotated 90° with the corners 124 enabling the device to rotate until the plate 116 has its major length extending transversely of the track and bracket so that the end edges thereof will engage the inner surface of the flange 106 and the inner surface of the flange 94 thereby preventing lateral movement of the track in a manner that will enable the track to be disengaged from the mounting bracket. The latch may be turned with a suitable screwdriver or other instrument and is constructed of a plastic material such as nylon or the like having sufficient resiliency to enable the latch to be rotated from a position with the plate 116 longitudinally oriented in relation to the track and bracket which enables quick assembly or disassembly of the track and bracket to a position with the long dimension thereof transverse of the track and bracket which secures the track and bracket assembled. The latch retainers 114 may be pre-assembled with the track 76 and retained in holes 121 by lugs 119 so that when the track section with the retaining latches mounted thereon is assembled onto the mounting rail, they will be in position to immediately be rotated with a screwdriver or the like thus quickly and effectively locking the track in supported engagement with the mounting rail 96.

The outer end edges of the outermost panels 12 which are in the form of half panels are provided with offset continuous cylindrical hinge elements 126 that are reinforced by internal ribs 128 with the edge of the door that is attached to one edge 130 of an opening including a jamb post 132 of channel-shaped construction including substantially parallel flanges 134 having internal ribs 136 thereon for engagement with a channel-shaped anchor 138 having outwardly extending ribs 140 along the outer edges of the outwardly projecting flanges on the channel 138. The web portion of the jamb 134 is designated by numeral 142 and includes a recess 144 in the form of a partial cylinder which rotatably receives the hinge element 126 thus hingedly anchoring the half panel 12 to the wall or other area 130 delineating an opening to be closed by the door.

The other edge of the opening designated by numeral 146 is provided with a channel-shaped anchor 148 similar to the channel-shaped anchor 138 and which also includes a rib 150 thereon with the anchor 148 receiving a jamb mold generally designated by numeral 152, the details of which are shown in FIG. 9. The jamb mold 152 includes a pair of flanges 154 and 156 interconnected by a generally centrally disposed flange 158 thus defining a cross-section of substantially H shape. The flanges 154 and 156 on one side of the web or flange 158 are provided with a pair of inward projections 160 and 162 for engagement with the side walls of the anchor 148 and the ribs 150 thereon as illustrated in FIG. 1 thus securing the jamb mold 152 in place on the anchor 148 so that the jamb mold is stationary with the wall 146 defining the opening. The edges of the flanges 154 and 156 on the opposite side of the web 148 are provided with rounded and slightly outwardly diverging end edges 164 which forms an entrance guide to the end post 166 oriented at the free edge of the folding door which is supported by roller assemblies 168 from the track and also connected to the half panel 12 by a cylindrical female hinge element 170 provided thereon similar to the recess 144 in the jamb post. The end post 166 may be provided with a suitable handle structure and latch or lock mechanism associated with the jamb mold 152 to secure the door in closed position with the edge of the vertical end post being frictionally received between the flanges 154 and 156 and abutting against the web 158 as illustrated in FIG. 1.

With this construction, the panels are quickly and easily assembled and disassembled and effectively hinged together and precluded from relative vertical movement in relation to each other when assembled and the track is quickly and effectively mounted onto the mounting bracket or rail therefor and the jamb post and jamb mold are easily connected to the door jambs or side walls of an opening to be closed thereby providing a door that is relatively simple in construction and easy to install.

The foregoing is considered as illustrative only of the principles of the invention. Further since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A folding closure comprising a plurality of elongated panels, hinge means connecting the vertical edges of adjacent panels together whereby the panels can be extended or retracted, each hinge means comprising a generally cylindrical member on one edge of each panel and forming a male hinge element, and a generally hollow channel-shaped member on the other edge of the panel and forming a female hinge element, said channel-shaped member projecting laterally from both surfaces of the panel and including a vertical entrance throat, said cylindrical member including a vertical entrance throat so that when the entrance throats are registered in end to end relation, the hinge elements may be interconnected by longitudinal movement of the panels to a position alongside of each other, the positioning and dimensions of the entrance throats being such as to prevent lateral movement and disengagement of the hinge elements, said channel-shaped member including inwardly extending flanges opposite to the entrance throat for engaging the external periphery of the cylindrical member during pivotal movement of the panels.

2. The structure as defined in claim 1 wherein one edge of the entrance throat on the channel shaped member forms an abutment for engaging the panel adjacent the cylindrical member to limit the movement of the panels to an extended position.

3. The structure as defined in claim 1 together with end caps forming a closure for the channel-shaped members to enable relative vertical movement of the panels during assembly and disassembly and preventing relative vertical movement between adjacent panels when assembled, each end cap including a top plate engaging the end of the channel-shaped member and forming a closure therefor, a mounting plate extending interiorly of the channel-shaped member, said mounting plate being telescopically retained in position in said channel-shaped member.

4. The structure as defined in claim 2 wherein the edge of the entrance throat in the channel-shaped member opposite to the abutting edge is in-turned and forms a retaining flange for the free edge of the entrance throat on the cylindrical member when the panels are moved toward an extended position thereby preventing lateral disassembly of the panels when they are moved to their normal retracted and extended positions.

5. The structure as defined in claim 4 wherein said cylindrical member includes a portion that is offset from the remainder of the panel with the offset portion being engaged by the edge of the throat on the channel-shaped member, the entrance throat on the cylindrical member being formed adjacent the point of connection of the cylindrical member and the offset portion of the panel.

6. The structure as defined in claim 1 together with carriage means supporting the central portion of certain of said panels, an overhead track receiving the carriage means for supporting the panels for accordion folding movement between extended and retracted positions, a mounting bracket for said track, and means connecting the track to the mounting bracket in response to vertical movement of the track into registry with the bracket and lateral movement of the track into engagement with the bracket.

7. The structure as defined in claim 6 wherein said connecting means includes a pair of depending flanges on the bracket, each having a laterally extending bottom flange thereon, said track including a pair of upwardly extending flanges each having a laterally extending flange thereon for registry with and engagement with the upper surfaces of the flanges on the bracket when the track is moved laterally in relation to the bracket with the laterally extending flanges on the track disposed above the laterally extending flanges on the bracket, and means insertable between certain of the track and bracket flanges to selectively prevent disengaging lateral movement of the track in relation to the bracket and selectively permit such movement for assembly and disassembly of the track and bracket.

8. The structure as defined in claim 7 wherein said means to selectively prevent lateral disengagement of the track in relation to the bracket includes a retaining member mounted for positioning between certain of the flanges on the track and bracket and movable to a position to fill the space between the flanges on the track and bracket thereby preventing relative lateral movement of the track in relation to the bracket.

9. The structure as defined in claim 1 together with carriage means connected to the upper central portion of certain of said panels, an overhead track assembly supportingly engaging the carriage means for supporting the panels for accordion folding movement between extended and retracted positions, said track assembly including an overhead track, and mounting bracket means for said track to enable assembly and disassembly of the track from the bracket means.

10. The structure as defined in claim 9 wherein said bracket means includes a substantially U-shaped bracket, said track including a substantially U-shaped track member having flanges thereon telescopically received in relation to the flanges on the bracket with the flanges on the track member and the flanges on the bracket including laterally extending flanges adapted to interengage with each other in response to lateral movement of the track member in relation to the bracket, and a rotatable member mounted centrally of the track member between the flanges thereon for engaging certain of the flanges on the track member and bracket to selectively prevent lateral displacement of the track in relation to the bracket for locking the track to the bracket.

11. The structure as defined in claim 4 wherein said mounting plate includes laterally projecting means received in recess means in said cylindrical member for preventing relative vertical movement between adjacent panels while permitting relative pivotal movement.

12. The structure as defined in claim 11 wherein said mounting plate frictionally engages the interior of the channel-shaped member, said recess means being in the form of an arcuate kerf in the cylindrical member, said projecting means being in the form of a flange projecting between the opposed edges of the inwardly extending flanges on the channel-shaped member.

13. A hinge connection between adjacent elongated edges of adjacent panels comprising a substantially channel-shaped member on the edge of one panel and a substantially cylindrical member on the edge of the adjacent panel, each of said members having a longitudinally continuous slot therein to enable assembly of the panels by sliding the cylindrical member endwise into the channel-shaped member, and means interconnecting said members to preclude relative longtitudinal movement between the panels after assembly while permitting relative pivotal movement therebetween, said means comprising an end cap including an end plate means engaging the end of said channel-shaped member, and mounting plate means extending into and being retained in the interior of the channel-shaped member, and projecting means on said mounting plate means engaging said cylindrical member, said cylindrical member including arcuate recess means receiving said projecting means to prevent relative longitudinal movement between the panels while permitting pivotal movement.

* * * * *